US011470903B2

(12) United States Patent
Ikeda

(10) Patent No.: US 11,470,903 B2
(45) Date of Patent: Oct. 18, 2022

(54) NECK COVER AND HELMET

(71) Applicant: SHOEI CO., LTD., Tokyo (JP)

(72) Inventor: Yoshiyuki Ikeda, Tokyo (JP)

(73) Assignee: SHOEI CO., LTD., Tokyo (JP)

( * ) Notice: Subject to any disclaimer, the term of this patent is extended or adjusted under 35 U.S.C. 154(b) by 511 days.

(21) Appl. No.: 16/478,488

(22) PCT Filed: Oct. 30, 2017

(86) PCT No.: PCT/JP2017/039191
§ 371 (c)(1),
(2) Date: Feb. 6, 2020

(87) PCT Pub. No.: WO2018/135070
PCT Pub. Date: Jul. 26, 2018

(65) Prior Publication Data

US 2020/0221805 A1 Jul. 16, 2020

(30) Foreign Application Priority Data

Jan. 20, 2017 (JP) ..... JP2017-008065

(51) Int. Cl.
*A42B 3/04* (2006.01)

(52) U.S. Cl.
CPC ..... *A42B 3/0473* (2013.01)

(58) Field of Classification Search
CPC ..... A42B 3/105; A42B 3/0472; A42B 3/12; A42B 3/121; A42B 3/124; A42B 3/125; A42B 3/128; A42B 3/06; A42B 3/221; A42B 3/223; A42B 3/225–227; A42B 3/326
See application file for complete search history.

(56) References Cited

U.S. PATENT DOCUMENTS

| | | | | |
|---|---|---|---|---|
| 5,095,550 | A | 3/1992 | Perlinger | |
| 10,362,829 | B2 * | 7/2019 | Lowe | A42B 3/064 |
| 2006/0195973 | A1 | 9/2006 | Ikeda | |

(Continued)

FOREIGN PATENT DOCUMENTS

| | | | |
|---|---|---|---|
| EP | 2 759 218 | A1 | 7/2014 |
| JP | S61179314 | A | 8/1986 |

(Continued)

OTHER PUBLICATIONS

International Search Report & Written Opinion for PCT/JP2017/039191, dated Dec. 19, 2017, pp. 1-7 (English translation included).

(Continued)

*Primary Examiner* — Katherine M Moran
(74) *Attorney, Agent, or Firm* — Thomas|Horstemeyer, LLP

(57) ABSTRACT

A neck cover and a helmet are provided that improve quietness of a helmet interior and that do not cause inconvenience for a wearer. In order to eliminate a gap between an opening portion of a helmet and a neck periphery of a wearer, insert-through holes, which are for passage of a chin strap that is attached to an inner side of the helmet, are formed in a portion, which covers a front portion (throat) of a neck, of a neck cover that is attached to a peripheral edge of the opening portion.

4 Claims, 6 Drawing Sheets

(56) References Cited

U.S. PATENT DOCUMENTS

| | | | | |
|---|---|---|---|---|
| 2009/0031483 | A1* | 2/2009 | Wallerberger | A42B 3/326 2/421 |
| 2012/0017357 | A1 | 1/2012 | Aria | |
| 2013/0007950 | A1* | 1/2013 | Arai | A42B 3/127 2/414 |

FOREIGN PATENT DOCUMENTS

| | | | |
|---|---|---|---|
| JP | H10168639 | A | 6/1998 |
| JP | 4545746 | B2 | 9/2010 |
| JP | 2012-026056 | A | 2/2012 |
| KR | 10-2014-0063677 | A | 5/2014 |
| WO | 86/05369 | A1 | 9/1986 |
| WO | 2005/120264 | A1 | 12/2005 |

OTHER PUBLICATIONS

Korean Office Action for Application No. 10-2019-7019931, dated Nov. 24, 2021, pp. 1-8 (Machine translation included).

* cited by examiner

NECK COVER AND HELMET

CROSS-REFERENCE TO RELATED APPLICATIONS

This application is the National Stage of International Application No. PCT/JP2017/039191, filed Oct. 30, 2017, which claims the priority to JP2017-008065, filed Jan. 20, 2017, which are entirely incorporated herein by reference.

TECHNICAL FIELD

The present invention relates to a neck cover for a helmet and to a helmet.

BACKGROUND ART

A helmet is worn in order to protect the head portion just in case an accident occurs. Further, in order for the protecting performance of the helmet to be exhibited, after the head portion is inserted in the helmet through an opening portion and the helmet is put-on, a chin strap must be tightened securely beneath the chin for stabilizing the helmet on the head portion of the wearer.

Further, in the case of motorcycle helmets, the function of, to a certain extent, blocking various types of harsh noises, such as engine sound, exhaust sound, wind noise, and the like, which arise at the time when the motorcycle travels also is exhibited. Among such noises, because engine sound and exhaust sound include relatively high frequency components, they are much reduced when passing through the helmet. In contrast, wind noise includes relatively low frequency components. Therefore, even if wind noise passes-through the helmet, it is difficult to reduce the wind noise, which causes great trouble to the rider.

Wind noise includes sound that is generated by friction between air and a vehicle body of the motorcycle or the body of the rider, and sound that leaks in from the opening portion for wearing at a lower end of the helmet. Thus, in order to improve the quietness at the helmet interior, the close fit of the helmet must be improved and the penetration of sound and wind must be cut-off. To this end, measures to prevent penetration of sound and wind from a gap between the opening portion and neck of the wearer have been taken. A screen that surrounds the entire periphery of the lower portion of the helmet is disclosed in Japanese Patent Application Laid-Open (JP-A) No. S61-179314. This helmet also functions for protecting against cold. However, because a surface area of the screen is too large, the weight of the helmet is heavy, and the burden on the neck of the wearer is large.

Further, a method of attaching a sheet material, which is made of an extensible material, to the entire periphery of the lower end of the helmet and covering the neck periphery and the region beneath the chin of the wearer is presented in U.S. Pat. No. 5,095,550. At the time of putting-on and taking-off the helmet, a flap at the chin portion is released, and an opening portion is widened. The putting-on and taking-off of such a helmet are not easy, and further, the wearer has the inconvenience that it is difficult to move his/her neck.

Moreover, a neck cover that surrounds the periphery of the neck of the wearer in a U-shape at the lower end of a helmet is presented in Japanese Patent No. 45455746. In such a neck cover, at the time when the wearer moves his/her neck, a gap is apt to be formed between the periphery of the neck and the neck cover.

SUMMARY OF INVENTION

Technical Problem

In view of the above-described circumstances, an object of the present invention is to provide a neck cover and a helmet that, by improving the close fit of the opening portion of the helmet, improve the quietness at the helmet interior and do not cause inconvenience for the wearer.

Solution to Problem

A neck cover of a first aspect is mounted to an opening portion, through which a head portion of a wearer is configured to be inserted, of a helmet, and the neck cover is configured to project out toward a wearer side from a peripheral edge of the opening portion, and an inner side peripheral edge portion of the neck cover at the wearer side extends so as to cover at least a range from a nape, which is a rear portion of a neck of the wearer, to a throat, which is a front portion of the neck of the wearer, and the neck cover is formed with a pair of left and right insert-through holes, through which a chin strap that is attached to an inner side of the helmet is inserted, at a portion of the neck cover that covers the throat of the wearer.

In accordance with the neck cover of the first aspect, after the wearer inserts his/her head in the opening portion and puts the helmet on, when the wearer fastens, beneath the chin, the chin strap that is passed-through the insert-through holes of the neck cover, the chin strap pulls the entire helmet toward the chin, and thus, the neck cover fits closely to the nape that is the rear portion of the neck of the wearer. Further, because the insert-through holes that exist at the left and the right of the neck cover are respectively pulled toward beneath the chin by the chin strap, the inner side peripheral edge portions of the left and right side portions of the neck cover are pulled toward the left and right side surfaces of the neck periphery of the wearer. Further, the front portion of the neck cover including the insert-through holes is fit closely to the throat of the wearer by the fastened chin strap. In this way, the neck periphery of the wearer is completely covered by the inner side peripheral edge portion of the neck cover. Further, because the neck cover is merely secured by the chin strap, movement of the neck of the wearer is not impeded. Moreover, at the time of taking-off the helmet, when the fastening of the chin strap is released, the inner side peripheral edge portion of the neck cover is separated from the front portion of the throat, and comes away from the neck of the wearer, and therefore, the helmet can be taken-off easily.

In a neck cover of a second aspect, the neck cover of the first aspect includes a portion that covers the nape of the wearer, a portion that covers from a left side portion of the neck of the wearer to the throat of the wearer, and a portion that covers from a right side portion of the neck of the wearer to the throat of the wearer.

In accordance with the neck cover of the second aspect, when the chin strap is fastened, the entire helmet is pulled toward the chin, and thus, the portion that covers the rear portion (the nape) of the neck of the wearer fits closely to the rear portion (the nape) of the neck of the wearer.

Further, the other portions of the neck cover, i.e., the portions that cover from the left and right side portions of the neck to the throat of the wearer, also fit closely to the neck periphery of the wearer as described in above paragraph [0009].

In a neck cover of a third aspect, in the neck cover of the first aspect or the second aspect, the inner side peripheral edge portion is flexible compared with a portion that is at a side further away from the wearer than the inner side peripheral edge portion.

In accordance with the neck cover of the third aspect, the inner side peripheral edge portion is more flexible than the other portions. Due thereto, the tension at the time of fastening the chin strap can be transmitted more effectively to the inner side peripheral edge portion.

A helmet includes a cushioning material that is attached to an inner side of the helmet, and that is configured to contact a wearer, and the neck cover of any one of the first aspect through the third aspect, which is made integral with the cushioning material.

In accordance with this helmet, due to the neck cover being made integral with the cushioning material of the helmet, the number of parts that are used is reduced, and accordingly, the number of assembly processes also can be reduced. Moreover, the weight of the helmet also can be lightened.

Advantageous Effects of Invention

As described above, the neck cover for a helmet and the helmet according to the present invention have the excellent effects of eliminating the gap between the opening portion of the helmet and the neck periphery of the wearer, and being able to improve the close fit of the helmet.

DESCRIPTION OF EMBODIMENTS

A helmet according to an embodiment of the present invention is described by using FIG. 1 through FIG. 5. Note that the front-rear direction front side as seen from the wearer in the state in which he/she is using the helmet is denoted by arrow FR, and the right side and the left side are denoted by arrow RH and arrow LH, respectively, and the vertical direction upper side is denoted by arrow UP. Further, in the following description, when merely front-rear, left-right and vertical directions are indicated, they refer to the front-rear, the left-right and the vertical as seen from the wearer who is in a state of wearing the helmet.

Figure 1:
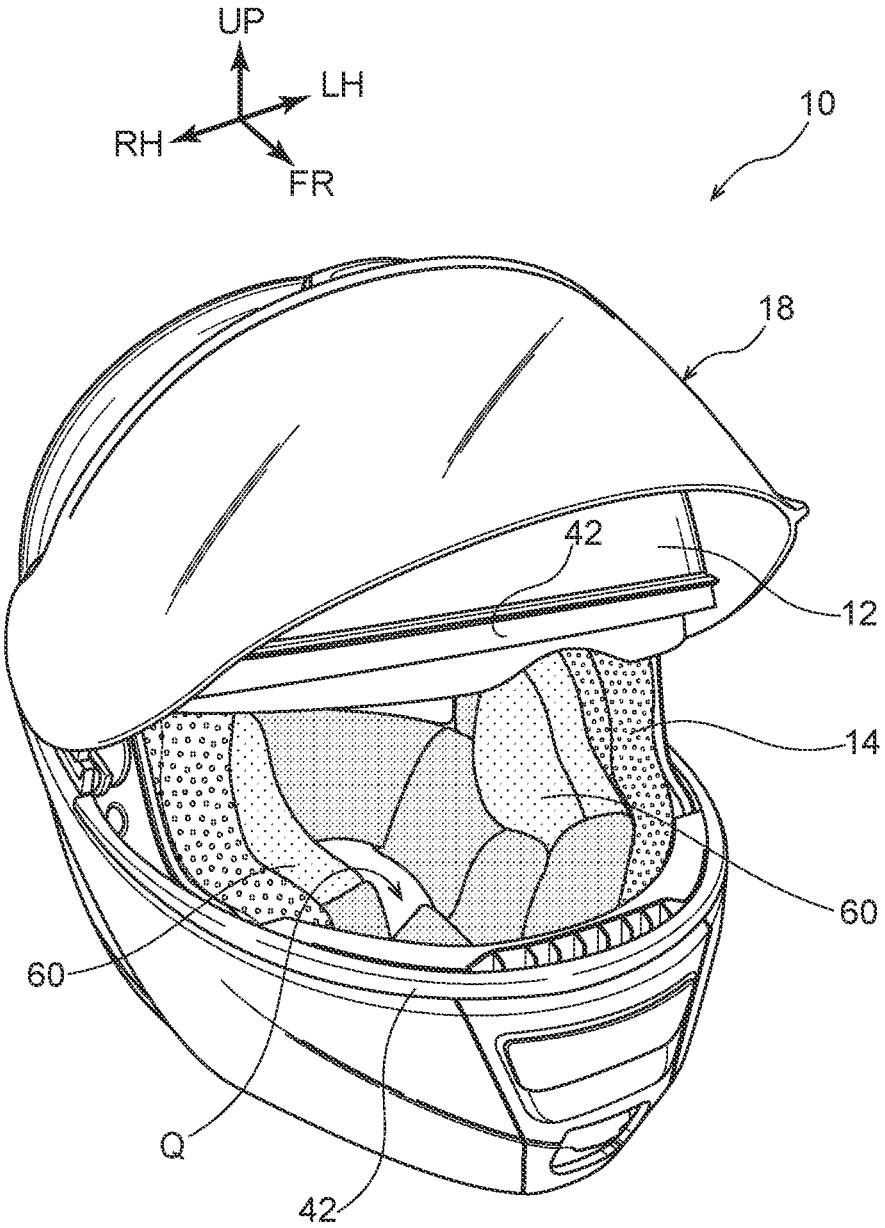
FIG. 1 is a perspective view showing a helmet according to an embodiment of the present invention, and shows a state in which a shield is open.

As shown in FIG. 1, at a helmet 10 of the present embodiment, opening portion Q through which the head is inserted in order to put on the helmet is at a lower end of the helmet. An opening window 42 that provides the wearer with a visual field is at a front surface of the helmet, and a shield 18 for opening and closing the opening window 42 is rotatably mounted.

An outer side of the helmet 10 is covered by a shell 12 of a hard material, and a liner 14 for absorbing impact is fixed to an inner side. Moreover, various types of cushioning materials for improving the comfort of wearing the helmet are attached to an inner side of the liner 14. In FIG. 1, the interior of the helmet 10 can be seen from the opening window 42, and cheek pads 60, which are one of the cushioning materials and which fit closely to the both cheeks of the wearer, are shown.

Figure 2A:
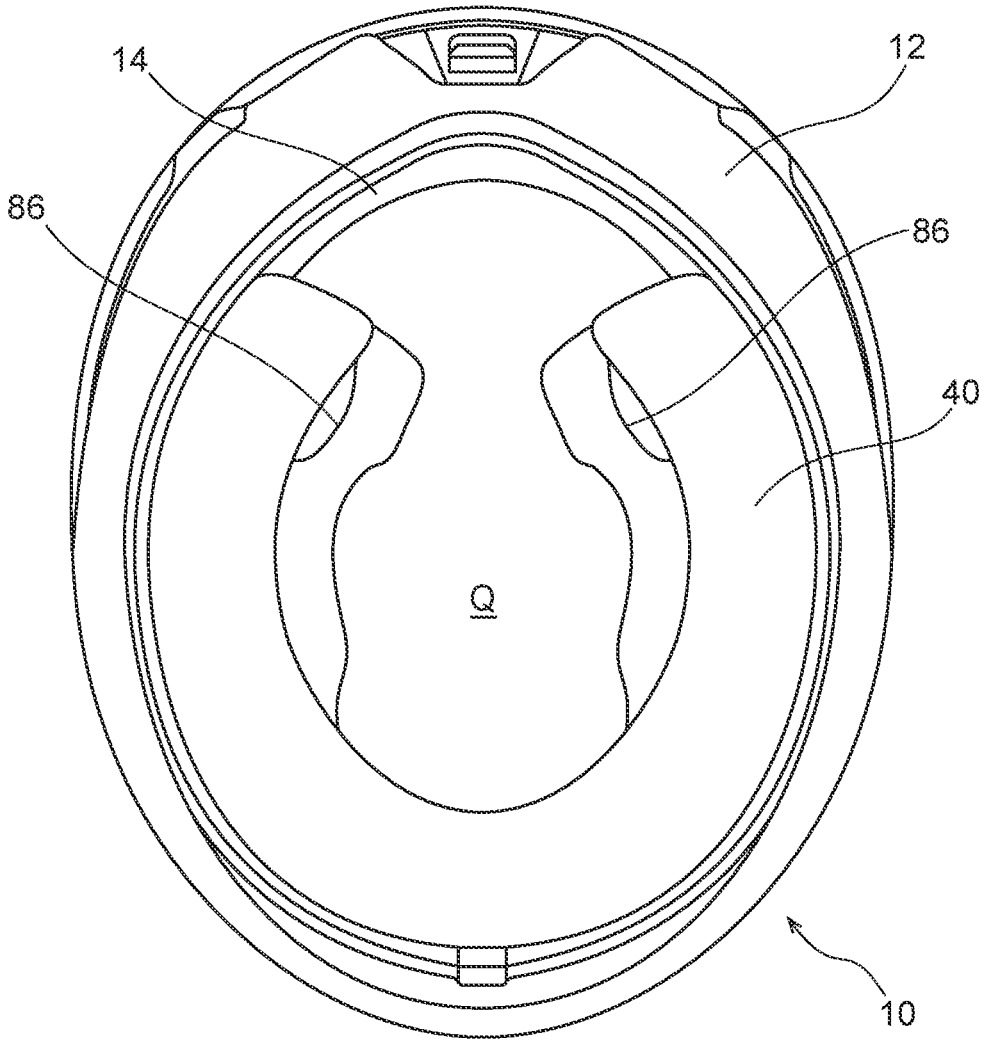
FIG. 2A shows an opening portion (bottom surface) of the helmet according to a first example of the present invention.

FIG. 2A shows the helmet of a first example. Further, FIG. 2A shows a position of a neck cover 40 at the opening portion Q.

The neck cover 40 protrudes-out toward an inner side from a peripheral edge of the opening portion Q of the helmet 10, and is formed in a U-shape, and can cover the entire periphery of the neck from the rear portion (the nape) to the front portion (the throat) of the neck of the wearer. Moreover, an outer side (facing the outer side of the helmet 10) of the neck cover 40 is covered by a material that is strong and extensible such as synthetic leather or the like, and a reverse side (facing the inner side of the helmet 10) is covered by a flexible material such as a pile fabric or the like, and a core material that is a foamed synthetic resin or the like is disposed at the middle. Therefore, the neck cover 40 fits closely to the neck periphery of the wearer, and does not hinder in putting-on and taking-off of the helmet 10 or movement of the neck.

Figure 2B:
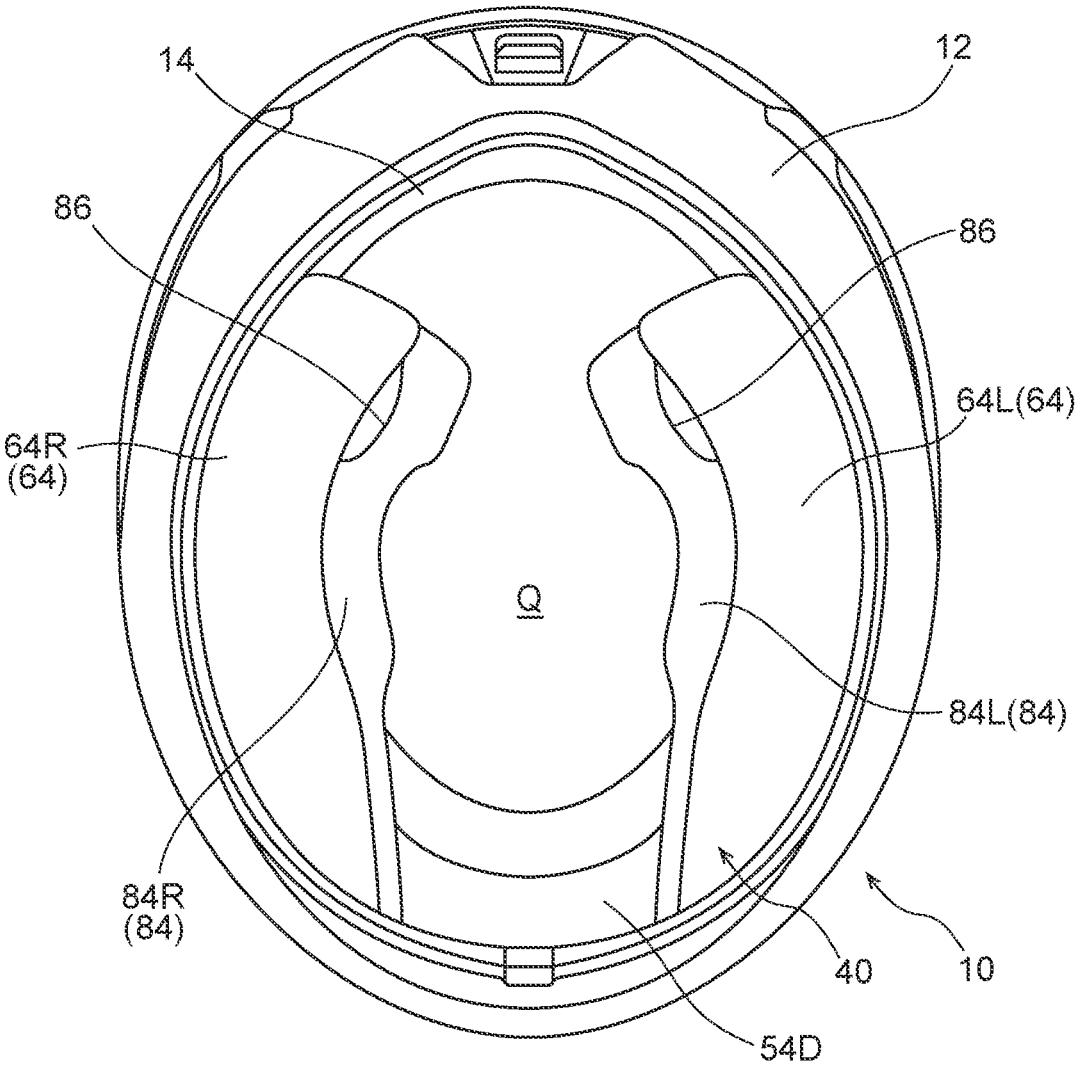
FIG. 2B shows the opening portion (bottom surface) of the helmet according to a second example of the present invention.

Further, FIG. 2B illustrates a helmet of a second example. A U-shaped neck cover 40 is structured so as to be divided into a neck pad 54D that is at the central portion, and other portions.

Further, the portions other than the neck pad 54D are divided into two portions which are a left side pad and a right side pad. Due thereto, it is shown that the neck cover 40 that is formed in a U-shaped is structured by at least three parts.

However, the pad portions at the left and the right (the left side pad and the right side pad) can be divided further.

In FIG. 2B, the left and right pad portions are further divided into two parts that are sub neck pads 64 and sub covers 84, with insert-through holes 86 being the boundaries thereof. The sub neck pads 64 are disposed at the peripheral edge of the opening portion Q, and project-out toward the inner side of the opening portion, and are connected to the sub covers 84 by a method such as sewing or adhesion or the like.

Moreover, in FIG. 2A and FIG. 2B, the neck cover 40 or the sub neck pads 64 are attached to the helmet 10 by being tucked by the shell 12 and the liner 14.

However, the neck cover 40 or the sub neck pads 64 may be fastened by hooks to the inner side of the liner 14, as is the case with the cushioning materials such as the cheek pads 60 (see FIG. 1). Or, the neck cover 40 or the sub neck pads 64 can be disposed at inner sides of the cushioning materials and directly fastened by fasteners or fastened by hooks to the cushioning materials.

In summary, provided that the neck cover 40 can be structured so as to cover the neck periphery of the wearer, the positions of attachment and the method of attachment are not limited.

However, preferably, it is desirable for the neck cover 40 or the sub neck pads 64 to be removably attached for washing or for the replacement of worn parts.

Figure 3:
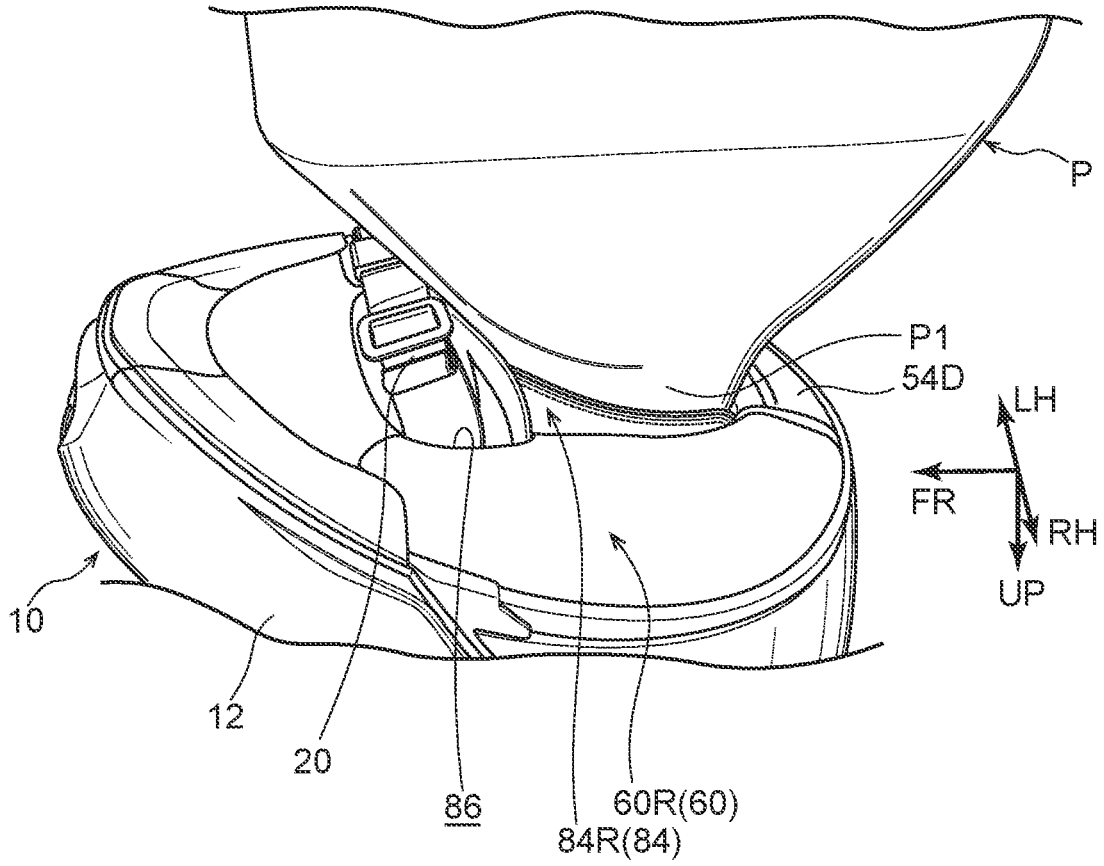
FIG. 3 shows a state in which the helmet according to the embodiment of the present invention is being worn.

A perspective view is shown in FIG. 3, in which the right side of a wearer P is viewed from an obliquely lower side in a state in which the helmet 10 according to the embodiment of the present invention is being worn by the wearer P and a chin strap 20 has been fastened. By fastening the chin strap 20, the entire helmet can be pulled close to the chin, and therefore, the rear portion of the neck cover 40 (see FIG. 2A) or the neck pads 54D (see FIG. 2B) fit closely to a portion of the neck of the wearer.

Further, the insert-through holes 86, which exist at the left and the right of the front portion of the neck cover 40 or the sub neck pads 64, are respectively pulled toward beneath the chin by the chin strap 20. Therefore, the inner side peripheral edge portions of the left and right side portions of the neck cover 40, or the inner side peripheral edge portions of the left and right sub covers 84, are respectively pulled toward the left and right side surfaces of neck periphery P1 of the wearer. Moreover, a front portion of the neck cover 40 or front end portions 84A of the sub covers (see FIG. 4), including the insert-through holes 86, fit close to the throat of the wearer due to the fastened chin strap, and therefore, the neck periphery P1 of the wearer is completely sealed. (See FIG. 3.)

Figure 4:
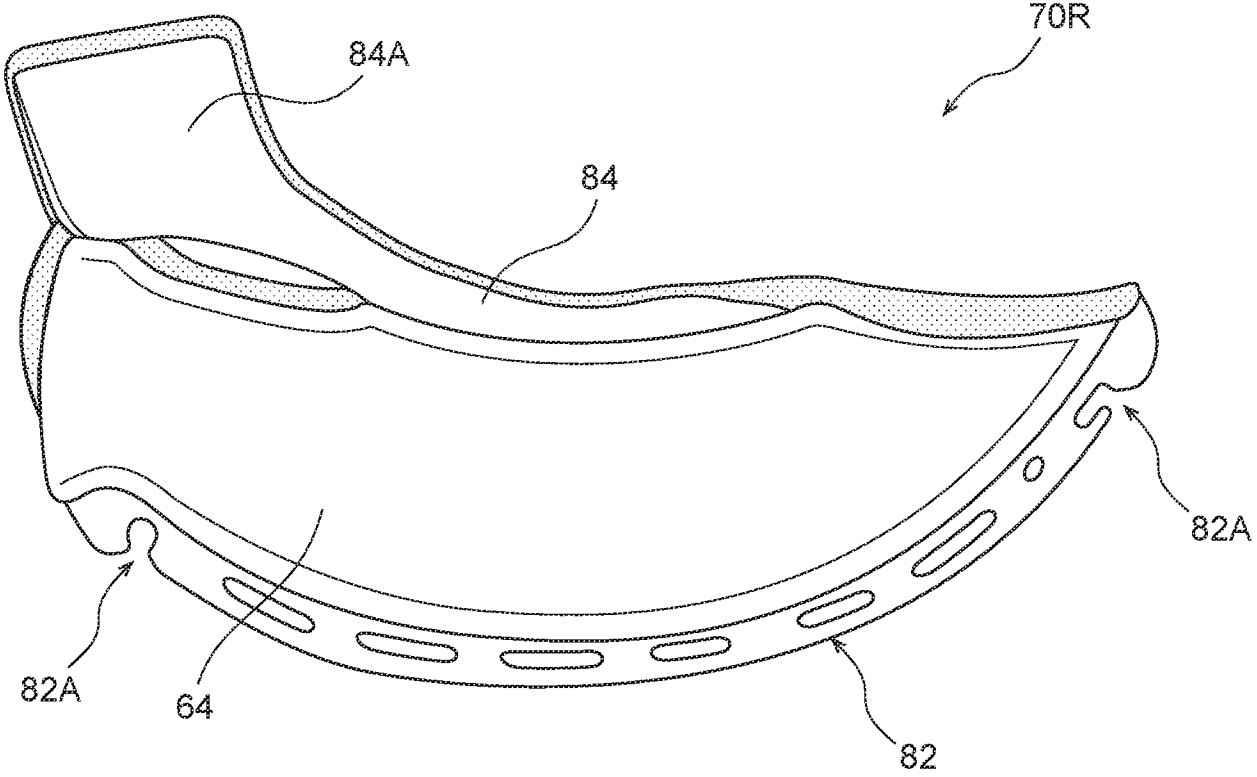
FIG. 4 is a bottom view in which a neck cover of the second example is viewed from a lower side, as an example of a neck cover of the helmet according to the embodiment of the present invention.

FIG. 4 shows a right side pad 70R of a second example. The right side pad 70R is divided into two portions which are the sub neck pad 64 and the sub cover 84. The sub cover 84 includes an inner side peripheral edge portion for fitting closely to the neck periphery P1 of the wearer. Therefore, it is preferable that the sub cover 84 be formed of a material that is extensible and is more flexible than the sub neck pad 64.

As described in paragraph [0020], at the neck cover 40, a material that is strong and is durable such as synthetic leather or the like is used at the outer side, and a core material of a foamed synthetic resin or the like is disposed at the middle, and the reverse side is covered by a pile fabric or the like.

At the sub cover 84, either a pliant material is used at the outer side thereof, or, even if it is the same material as the neck cover, by selecting a thin material or by changing the fabric at the reverse side to a material that is extensible, the close fit to the neck periphery P1 of the wearer can be improved.

Further, by providing the insert-through holes 86 at the sub covers 84, the tensile force at the time of fastening the chin strap 20 can be transmitted more effectively and efficiently to the inner side peripheral edge portions.

Further, at the right side pad 70R, an anchor plate 82 is attached by sewing or the like to an peripheral edge portion that is at a side opposite the sub cover 84, and further, anchor grooves 82A of the anchor plate 82 are anchored on unillustrated boss portions that are fixed between the shell 12 and the liner 14 (see FIG. 2A and FIG. 2B).

However, as described in paragraph [0023], the position of attachment and the method of attachment are not limited.

Figure 5:
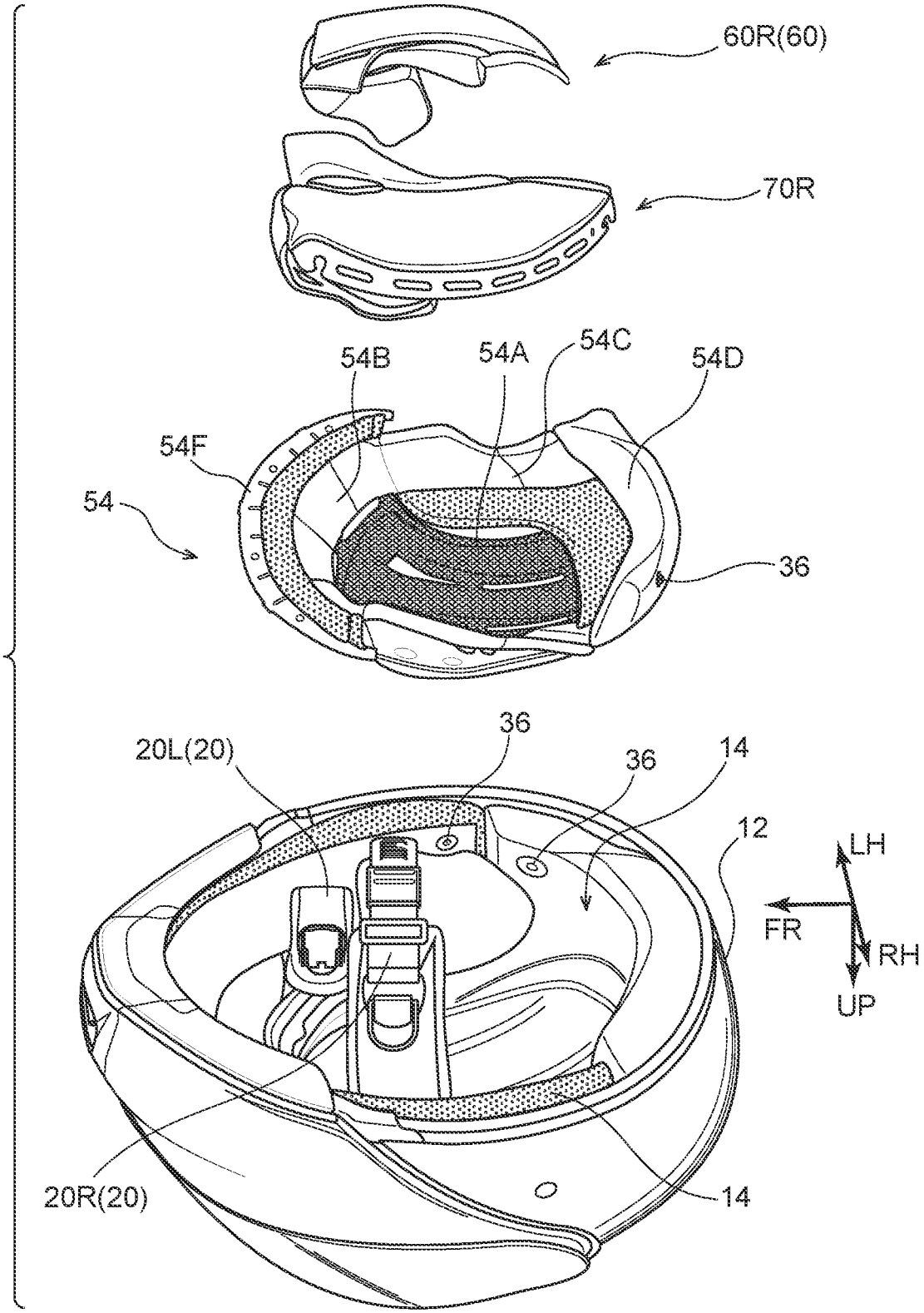
FIG. 5 shows a center pad and a cheek pad that have been removed from the helmet, and the helmet, in order to show the structure of cushioning materials of the helmet according to the embodiment of the present invention.

FIG. 5 shows a center pad and a cheek pad that have been removed from the helmet of the second example according to the embodiment of the present invention, and the main body of the helmet.

The cheek pad 60 is a cushioning material that is disposed along the cheek of the wearer.

In FIG. 5, a cheek pad 60R (right side) is made integral with the right side pad 70R by sewing, adhesion, fastening by hooks, or the like. As described in paragraph [0026], the right side pad 70R is anchored to the helmet 10, and further, the cheek pad 60 is anchored by hooks 36 that are at the helmet interior (the side surface of the liner 14).

In this way, the right side pad 70R is detachably attached to the helmet.

Further, although not illustrated, a left side pad 70L also is attached to the helmet similarly.

The center pad 54 has crown pads (portions extending over 54A, 54B and 54C in FIG. 5) and the neck pad 54D that are respectively disposed along the head portion (the parietal region, the forehead and the temporal regions) and the rear portion (the nape) of the neck of the wearer.

Further, the center pad 54 has a front side anchor portion 54F at the portion that extends out toward the front side from the lower end portion of the forehead placement portion 54B, and the front side anchor portion 54F is anchored at the front side of the liner 14. Moreover, the hooks 36 are provided at the reverse side of the neck pad 54D, and are anchored on the rear side of the liner 14.

As described above, due to the neck cover of the second example being formed integrally with the cushioning materials of the helmet 10, the neck cover can be detachably attached to the helmet.

Further, due to the neck cover being made integral with the cushioning materials, the number of parts that are used is reduced, and accordingly, the number of assembly processes also can be reduced. Moreover, the weight of the helmet also can be lightened.

Further, if the cheek pads 60 and the neck pad 54D are connected, a U-shaped cushion is formed at the peripheral edge of the opening portion Q. When the neck cover 40 is connected to this U-shaped cushion, there is the state of FIG. 2A.

Namely, it is also possible to make the neck cover of the first example integral with the cushioning materials of the helmet.

(Operation and Effects)

Operation and effects of the present embodiment are described next.

As shown in FIG. 2A, FIG. 2B and FIG. 3, at the neck cover 40 of the present embodiment, after the wearer inserts his/her head through the opening portion Q and puts the helmet 10 on, when the wearer fastens, beneath the chin, the chin strap 20 that has been passed-through the insert-through holes 86 of the neck cover 40, the chin strap 20 pulls the entire helmet 10 toward the chin, and therefore, the neck cover 40 fits closely to the rear portion of the neck of the wearer P. Further, because the insert-through holes 86 that exist at the left and the right of the neck cover 40 are respectively pulled toward beneath the chin by the chin strap 20, the inner side peripheral edge portions of the left and right side portions of the neck cover 40 are pulled toward the left and right side surfaces of the neck periphery of the wearer. Further, the front portion of the neck cover 40 including the insert-through holes 86 is fitted closely to the throat of the wearer by fastening the chin strap 20.

In this way, the neck periphery P1 of the wearer P is completely covered by the inner side peripheral edge portion of the neck cover 40. Further, because the neck cover 40 is merely secured by the chin strap, movement of the neck of the wearer P is not impeded. Moreover, at the time of taking-off the helmet 10, when the fastening of the chin strap 20 is released, the front portion of the throat as well as the inner side peripheral edge portion of the neck cover 40 at the same time come away from the neck of the wearer P, and therefore, the helmet can be taken-off easily.

Note that the explanation of the present embodiment describes an example of a helmet for a rider of a motorcycle. However, the neck cover of the present embodiment can be used provided that there is a helmet that has an opening portion, through which the head is inserted in order to put the helmet on, and a chin strap for retaining the helmet, as described above. Namely, the present invention can be utilized for helmets for bicycles, sports, snowmobiling, water skiing, and the like.

Although an embodiment of the present invention has been described above, the present invention is not limited to the above, and, of course, can be implemented by being modified in various ways other than the above without departing from the scope thereof.

The invention claimed is:

1. A neck cover configured to be mounted to an opening portion, through which a head portion of a wearer is configured to be inserted, of a helmet, the neck cover configured to project out toward a wearer side from a peripheral edge of the opening portion, an inner side peripheral edge portion of the neck cover configured to extend at least from a nape or a rear portion of a neck of the wearer, to a throat or a front portion of the neck of the wearer, and the neck cover being formed with a pair of left and right insert-through holes, through which a chin strap that is fixed to an inner side of the helmet is inserted, at a portion of the neck cover configured to cover the throat of the wearer, wherein:

the neck cover is structured so as to be divided into a neck pad that is at a central portion, a left side pad, and a right side pad;

the right side pad and the left side pad are respectively divided into portions which include a sub neck pad and a sub cover;

each of the sub covers includes the inner side peripheral edge portion for fitting closely to the neck periphery of the wearer, and each of the sub covers is more flexible than the sub neck pads, which are disposed at a side of shell of the helmet.

2. The neck cover of claim 1, wherein the neck cover includes a portion that is configured to the nape of the wearer, a portion that is configured to cover from a left side portion of the neck of the wearer to the throat of the wearer, and a portion that is configured to cover from a right side portion of the neck of the wearer to the throat of the wearer.

3. A helmet comprising:

a cushioning material that is attached to an inner side of the helmet, and configured to contact a wearer; and the neck cover of claim 1, wherein the neck cover is made integral with the cushioning material.

4. The helmet of claim 3, wherein the neck cover includes a portion that is configured to cover the nape of the wearer, a portion that is configured to cover from a left side portion of the neck of the wearer to the throat of the wearer, and a portion that is configured to cover from a right side portion of the neck of the wearer to the throat of the wearer.

* * * * *